US009181596B2

(12) United States Patent
Garcin et al.

(10) Patent No.: US 9,181,596 B2
(45) Date of Patent: Nov. 10, 2015

(54) METHOD AND DEVICE FOR TREATING A MATERIAL EXPOSED TO A MAGNETIC FIELD

(75) Inventors: Thomas Garcin, Jacob Bellecombette (FR); Sophie Rivoirard, Lans en Vercors (FR); Pierre-Frédéric Sibeud, Moirans (FR); Eric Beaugnon, Gieres (FR)

(73) Assignees: CENTRE NATIONAL DE LA RECHERCHE SCIENTIFIQUE (CNRS), Paris (FR); UNIVERSITE JOSEPH FOURIER—GRENOBLE 1, St. Martin d'Hères (FR)

( * ) Notice: Subject to any disclaimer, the term of this patent is extended or adjusted under 35 U.S.C. 154(b) by 677 days.

(21) Appl. No.: 13/388,171

(22) PCT Filed: Jul. 29, 2010

(86) PCT No.: PCT/EP2010/061028

§ 371 (c)(1), (2), (4) Date: Jan. 31, 2012

(87) PCT Pub. No.: WO2011/012673

PCT Pub. Date: Feb. 3, 2011

(65) Prior Publication Data

US 2012/0125486 A1 May 24, 2012

(30) Foreign Application Priority Data

Jul. 31, 2009 (FR) ..... 09 55380

(51) Int. Cl.
*C21D 1/04* (2006.01)

(52) U.S. Cl.
CPC ..... *C21D 1/04* (2013.01)

(58) Field of Classification Search
CPC ..... C21D 1/04
USPC ..... 266/249; 219/647
See application file for complete search history.

(56) References Cited

U.S. PATENT DOCUMENTS

| | | | |
|---|---|---|---|
| 2,002,696 | A | 5/1935 | Kelsall |
| 4,769,091 | A | 9/1988 | Yoshizawa et al. |

(Continued)

FOREIGN PATENT DOCUMENTS

| | | |
|---|---|---|
| DE | 1 259 367 | 1/1968 |
| DE | 31 29 939 | 3/1983 |
| FR | 2 510 142 | 1/1983 |

OTHER PUBLICATIONS

Bonvalot, M. et al., "Magnetic levitation stabilized by eddy currents"; Elsevier—Journal of Magnetism and Magnetic Materials; vol. 151; 1995; pp. 283-289.

(Continued)

*Primary Examiner* — Scott Kastler
(74) *Attorney, Agent, or Firm* — Harness, Dickey & Pierce, P.L.C.

(57) ABSTRACT

The disclosure concerns a method for treating a material in a static magnetic field having an intensity of more than 1 Tesla, including the following steps:

a first step to heat the material, a second step to apply to the material a thermal shock and/or thermomechanical treatment and/or chemical treatment, wherein during at least the second treatment step, the material is subjected to the magnetic field while being held in position within the magnetic field.

The disclosure also concerns a device for implementing the method, the device including:

a support to hold the material during the steps of the cycle, a device to apply the static magnetic field capable of generating a magnetic field of intensity higher than 1 Tesla, a first system allowing heating of the material, a second system for implementing the subsequent step of the cycle.

14 Claims, 4 Drawing Sheets

(56) References Cited

U.S. PATENT DOCUMENTS

| | | | | |
|---|---|---|---|---|
| 5,225,005 | A | 7/1993 | Burrage et al. | |
| 5,494,534 | A | 2/1996 | Leu | |
| 5,535,990 | A | 7/1996 | Burrage et al. | |
| 5,885,370 | A | 3/1999 | Shimotomai et al. | |
| 6,291,403 | B1 | 9/2001 | Yamazaki | |
| 6,375,760 | B2 | 4/2002 | Maruta et al. | |
| 6,592,682 | B1 | 7/2003 | Fruchart et al. | |
| 6,773,513 | B2 | 8/2004 | Ludtka | |
| 7,161,124 | B2 | 1/2007 | Kisner et al. | |
| 2011/0000588 | A1* | 1/2011 | Bogicevic et al. | 148/559 |
| 2012/0085753 | A1* | 4/2012 | Fitch et al. | 219/647 |
| 2012/0125486 | A1* | 5/2012 | Garcin et al. | 148/218 |

OTHER PUBLICATIONS

Braithwaite, D. et al., "Magnetically controlled convection in a paramagnetic fluid"; Letters to Nature; Sep. 24, 1991; 3 pages.

Fukuda, T. et al., "Magnetic field dependence of γ-α equilibrium temperature in Fe-Co alloys"; Institute of Physics Publishing; Journal of Physics: Conference Series; vol. 51; 2006; pp. 307-310.

Gaucherand, F. et al., "Magnetic susceptibility of high-Curie-temperature alloys near their melting point"; Elsevier—Physica B; vols. 294-295; 2001; pp. 96-101.

Hao, X. et al., "Effects of a High Magnetic Field on Transformation Temperatures in Fe-based Alloys"; ISIJ International; vol. 46, No. 9; 2006; pp. 1271-1273.

Legrand, B.A. et al., "Orientation of samarium-cobalt compounds by solidification in a magnetic field"; Elsevier—Journal of Alloys and Compounds; vols. 275-277; 1998; pp. 660-664.

Ludtka, G.M. et al., "In situ evidence of enhanced transformation kinetics in a medium carbon steel due to a high magnetic field"; Elsevier—Scripta Materialia; vol. 51; 2004; pp. 171-174.

Ohtsuka, H. et al., "Structural control of Fe-based alloys through diffusional solid/solid phase transformations in a high magnetic field"; Science and Technology of Advanced Materials; vol. 9; 2008; pp. 1-7.

Rivoirard, S. et al., "Dilatation measurements for the study of the α/γ transformation in pure iron in high magnetic fields"; Institute of Physics Publishing; Journal of Physics: Conference Series 51; 2006; pp. 541-544.

Villaume, A. et al., "Misalignment angles' reduction in Bi2212 multifilaments melted by dynamic heat treatment under a magnetic field"; Superconductor Science and Technology; vol. 20; 2007; pp. 691-696.

Yasuda, H. et al., "Effect of Magnetic Field on Periodic Structure Formation in Pb-Bi and Sn-Cd Peritectic Alloys"; Materials Transactions, JIM; vol. 41, No. 8; May 19, 2000; pp. 1005-1012.

Zhang, Y.D. et al., "Microstructural features induced by a high magnetic field in a hypereutectoid steel during austenitic decomposition"; Elsevier—Scripta Materialia; vol. 54; 2006; pp. 1897-1900.

* cited by examiner

METHOD AND DEVICE FOR TREATING A MATERIAL EXPOSED TO A MAGNETIC FIELD

CROSS-REFERENCE TO RELATED APPLICATIONS

This application is a U.S. National Phase Entry of International Application No. PCT/EP2010/061028, filed on Jul. 29, 2010, which claims priority to French Patent Application Serial No. 0955380, filed on Jul. 31, 2009, both of which are incorporated by reference herein.

FIELD OF THE INVENTION

The present invention concerns a method and device for treating a material exposed to a magnetic field.

BACKGROUND OF THE INVENTION

The producing of materials in a magnetic field—in particular a so-called "intense" magnetic field i.e. whose intensity is of the order of several Tesla even several tens of Tesla—is the subject of numerous scientific investigations. For example, a branch of activities called "magneto-science" has emerged which sets out to combine the application of a magnetic field with a method for producing a material. The magnetic field is then considered to be an additional parameter which may influence either the morphology of the material being produced or the kinetics of the production methods used, in the same manner as parameters such as temperature, pressure or chemical composition. In this respect, the magnetic field can be used to modify the properties of use of a material. While numerous magnetic field effects are still the subject of fundamental research, others are currently already involved in industrial processes for the synthesis of materials.

The invention developed herein targets both a research and development environment and the industrial environment. In particular, it is desired to be able to use a magnetic field to impact the microstructure and hence the characteristics of a material, as an alternative to means already widely optimized for many years in metallurgy such as variations in chemical composition, the combined use of thermomechanical treatments (hot, cold deformation) and intermediate heat or chemical treatments. Under the effect of a sufficiently intense magnetic field, i.e. of intensity typically higher than 1 Tesla, magnetic energy is no longer negligible compared with the chemical energy involved in the different types of transformations encountered in a material throughout its production. This is the reason why transformation kinetics and microstructures can be modified through the application of a magnetic field.

In metallurgy, the properties of use of an alloy strongly depend upon the history of its production. Therefore, to examine this history and in particular to observe structures that are stable at high temperature, it is necessary to halt the changes in the microstructure at different stages of its formation. This is achieved via quenching to set the microstructure of the alloy at ambient temperature.

This method allows ex-situ quantitative analysis of microstructures. This analysis, coupled with in-situ measurements of transformation temperature is used to determine phase diagrams or other types of predictive diagrams such as TTT diagrams (Time-Temperature-Transformation) or CCT (Continuous Cooling Transformation) diagrams. TTT diagrams are used to examine the kinetics of phase or state transitions. This type of diagram is obtained with step quenching experiments followed by a given temperature hold, for ex-situ microstructural characterization. The transformation rate can then be measured. CCT diagrams are used to predict the microstructure of a solid subjected to thermomechanical treatments. They show the different states through which a given alloy grade may pass on cooling. They correspond to cooling conditions close to those of industrial conditions. Also, the microstructures of most interest for industrial applications very often involve non-equilibrium structures.

It is therefore necessary not only for research purposes but also for industrial applications to be able to examine and make use of the effect of a magnetic field on the formation of any type of microstructure, and in particular of these non-equilibrium structures. However, it is not possible at the current time to perform quenching under the simultaneous effect of a static magnetic field.

Conventionally, quenching in a liquid medium requires the displacement of the treated test-piece towards a medium dedicated to quenching thereof. Yet in a magnetic field, any movement of a conductive or magnetic material generates strong stresses on the device generating the magnetic field. Firstly an electric charge q, moving in a magnetic field B, at velocity v, is subjected to Lorentz forces denoted $d\vec{F}$ which oppose the movement which set them up:

$$d\vec{F}=q\cdot\vec{v}\wedge\vec{B}$$

Secondly, a conductor of length dl, in which an electric current passes of intensity I, in a magnetic field B, is subjected to Laplace forces $d\vec{F}$, as per the equation:

$$d\vec{F}=I\cdot d\vec{l}\wedge\vec{B}$$

Therefore, two magnetic systems (i.e. the ferromagnetic material and the generator winding) are coupled via mutual induction.

The movement of a ferromagnetic material may therefore perturb, even damage, the magnet supplying the field which is then subjected to possibly major mechanical forces. To conduct quenching, the processes developed up until now consist of extracting the material from the furnace, in which it is subjected to the magnetic field, and immersing it in a quench bath which is located outside the magnetic field. With this process, complex to perform on account of the restricted available space, the magnetic field applied to the material is not constant throughout the entire treatment. The transfer of the material (from the area where the field is applied to the zero-field area) firstly forms a variation in the field applied to the material during its treatment, and secondly the material is no longer subjected to the field when it is being cooled. In addition, this method may be detrimental to the magnet supplying the field.

In U.S. Pat. No. 5,535,990 published on 16 Jul. 1996, an apparatus was proposed allowing the heat treatment of a test-piece whilst applying a magnetic field thereto by means of coils wound around the test-piece to be treated. Said apparatus does not however allow the application of an intense magnetic field, i.e. higher than 1 Tesla, to the test piece and it cannot in any way be adapted for this purpose. In addition, the arrangement proposed in this patent has a certain number of disadvantages, in particular in terms of wear of the apparatus, since the winding used undergoes the same heat treatments as the test-piece.

One alternative for obtaining rapid cooling of the material in the presence of an intense magnetic field consists of sending a gas flow in the direction thereof (e.g. argon or helium) under pressure and at ambient temperature. However, this solution does not allow sufficiently rapid cooling of the material that could be likened to a quench. Therefore, the cooling rates thus obtained do not exceed 50° C./s between 1000° C. and 500° C. and are much lower at lower temperatures when the cooling property of the gas becomes negligible. With quenching in a liquid bath, the cooling rates are globally constant over all temperature ranges and may exceed 150° C./s with good bath sizing.

A first objective of the invention is therefore to define a method allowing the performing of the entire heat treatment (i.e. heating and quenching in a liquid bath) or at least the quench step under the influence of a static magnetic field. Also, in addition to the quench just mentioned, it is envisaged to apply other treatments to the material at high temperature under the effect of a magnetic field. For this purpose, another device is substituted for the quench bath. Amongst the envisaged treatments, mention may be made of surface treatments in salt bath, thermo-mechanical treatments (rolling, forging), etc. A second objective of the invention is therefore to define a method and associated device which more generally allow the performing of at least a step to apply a thermal shock, thermomechanical treatment and/or chemical treatment to a material under the effect of a static magnetic field, truly adaptable on an industrial scale for substantially continuous treatment processes for example.

SUMMARY

One first object of the invention concerns a method for treating a material in a static magnetic field having an intensity of more than 1 Tesla, comprising the following steps:

- a first step to heat the material,
- a second step to apply a thermal shock and/or thermomechanical treatment and/or chemical treatment to the material, said method being characterized in that, at least during said second step of the treatment, the material is subjected to a static magnetic field and in that it is held in position inside said magnetic field.

By "static magnetic field" is meant herein, as opposed to an alternating magnetic field, a magnetic field whose intensity at a given point does not vary cyclically with time and whose polarity does not vary over time. Therefore, the intensity at a given point of said static magnetic field may be constant throughout the entire treatment or the step under consideration. Alternatively, the set point value may be modified at different times during the treatment. By "thermal shock" is meant herein a treatment which comprises placing the material under non-equilibrium conditions so as suddenly and fully to modify the structure and physical characteristics thereof. This term is defined in opposition to a heat treatment in which the temperature of the material varies sufficiently slowly so that the transformation processes give rise to a structure composed of stable, scarcely stressed phases.

For example, the treatment applied to the material during the second step of the method may, in non-limiting manner, comprise:

- a thermal shock, including for example quenching by immersion in a liquid bath such as water or oil, or so-called step heat treatment i.e. in which temperature holds separated by sudden steep variations in temperature are desirable;
- a chemical treatment such as surface treatment for example (e.g. nitriding, nitrocarbiding or derivatives thereof) by immersion in a salt bath, but also treatment in the volume of the material such as decarburization treatments in a reducing atmosphere in which the chemical composition (here the weight percentage of carbon) may vary considerably;
- a mechanical or thermomechanical treatment, including mechanical deformation (e.g. compression of forming by deep drawing).

To carry out the steps of the treatment, the heating means and the means for implementing the second step are moved relative to the magnetic field.

Advantageously, the method comprises a step to measure physical properties of the material, concomitant with the first and/or second step or after the second step. Advantageously, the treatment method comprises a third step which comprises applying a thermal shock to the material, and in that the material is subjected to said magnetic field being held in position within the magnetic field during said third step. Preferably, the second step consists of applying to the material a first thermal shock, and the third step consists of applying a second thermal shock of opposite type to the first thermal shock.

Another subject of the invention concerns a device for applying to a material a treatment cycle within a static magnetic field, said treatment cycle comprising heating of the material followed by a subsequent step comprising a thermal shock, a chemical treatment and/or thermomechanical treatment, said device comprising:

- a support for holding the material during the steps of the cycle,
- a device to apply said static magnetic field capable of generating a magnetic field of intensity higher than 1 Tesla,
- a first system allowing the heating of the material,
- a second system to implement said subsequent step of the cycle, said device being characterized in that the support is arranged so as to hold the material in position relative to the magnetic field during the steps of the cycle, and in that the first and second systems are mobile relative to the magnetic field.

For this purpose, the device comprises a device for translating the first and second systems relative to the material arranged on the support and to the magnetic field. Preferably, the device for applying the static magnetic field is fixed relative to the support and to the treatment device in general, whilst the first and second systems are mobile relative to the support and to the treatment device in general.

According to another possible embodiment, the device for applying the static magnetic field is mobile relative to the treatment device in general along a first plane of movement e.g. the horizontal plane, whilst the first and second systems are mobile relative to the treatment device in general along a second plane of movement perpendicular to the first plane of movement e.g. a vertical plane. According to different embodiments of the invention, the second system comprises a quench bath, a bath adapted for performing chemical treatment of the material and/or a system for mechanical deformation of the material. In particularly advantageous manner, the device further comprises a system for measuring physical properties of the material.

Further advantageously, the treatment device is characterized in that:

- the device for applying the static magnetic field has a shape of revolution with a field hole;
- the support is a rigid part arranged to centre the material on the axis of revolution of the device for applying the static magnetic field, and the first system and the second system are secured to each other and are able to translate along the axis of revolution of the magnet under the action of a propelling device.

For said treatment device, the device for applying the static magnetic field advantageously comprises an electro-magnet, a superconducting magnet, a resistive magnet, a hybrid magnet or a group of permanent magnets. According to another aspect, the treatment device may comprise a device for applying the static magnetic field having at least three superconducting magnets capable of moving in a direction orthogonal to the axis of translation of the first and second systems.

BRIEF DESCRIPTION OF THE DRAWINGS

Other characteristics and advantages of the invention will be better understood on reading the following description with reference to the appended drawings in which.

DETAILED DESCRIPTION

Figure 1:
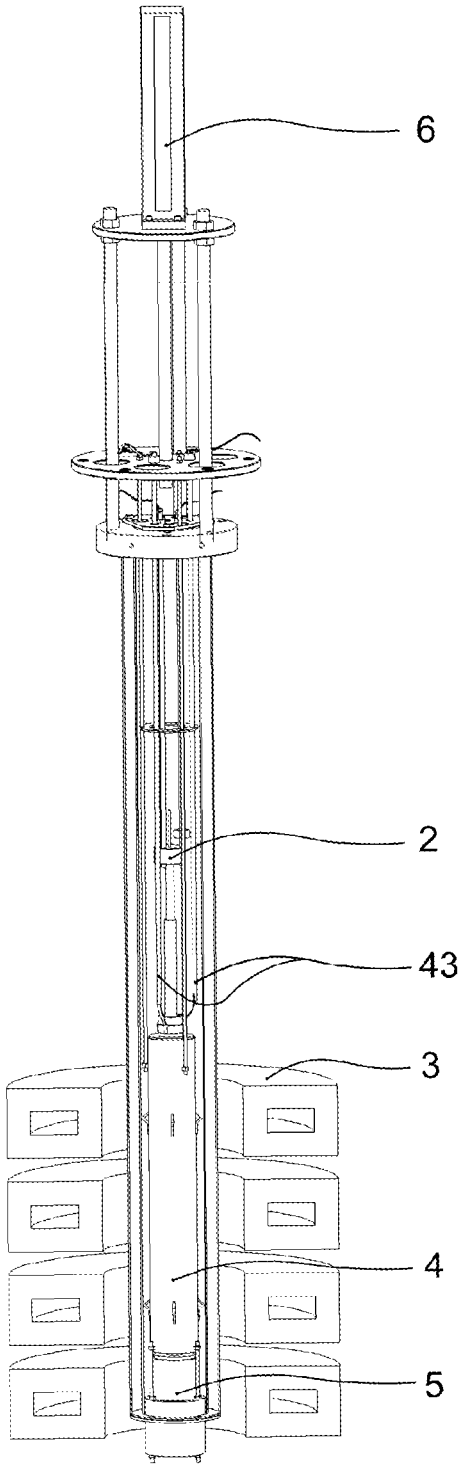
FIG. 1 is an overall view of a device according to the invention adapted for the treatment of a test-piece of cylindrical shape.

The method according to the invention finds application not only in the treatment of samples of small size for example for experimental purposes in a laboratory, but also in the treatment of large-size test-pieces on industrial scale. A description is given below of the devices adapted for these different cases.

The magnetic field is generated by any device allowing the desired intensity to be obtained, which is typically higher than 1 Tesla. The device for applying the static magnetic field is known per se. It may be a system of permanent magnets, an electro-magnet, a superconductor winding, a resistive magnet or a hybrid magnet (combination of a resistive magnet and of a superconductor winding). Preferably, the device for applying a static magnetic field has a shape of revolution along an axis of revolution, and comprises a field hole. By field hole, reference is made to a field hole at ambient temperature i.e. a hole or opening through which the magnetic field passes and in which it is possible to position an element. Reference is made to a field hole at ambient temperature as opposed to a field hole in a liquid helium bath which generally corresponds to a magnet immersed in a bath of liquid helium for which it is therefore not possible to position any element in the field hole.

The device for applying the static magnetic field is preferably provided to deliver a unidirectional static magnetic field inside the field hole along the axis of revolution of the device, which is for example of generally cylindrical geometry. Preferably, it is provided with a water jacket which protects the magnet against thermal radiation emanating from the device.

The treatment method may comprise a heat treatment followed by quenching in a quench bath but, as will be seen below, the treatment device may be adapted so that, after the heating step, it allows the application of any other thermal shock (such as rapid heating for example), a thermomechanical treatment and/or chemical treatment. The quench bath is preferably sized to allow a drop in temperature at a rate of at least 50° C./s, preferably of at least 100° C./s, more preferably of at least 150° C./s, further preferably of at least 500° C./s. In general, the device is designed so as to hold the material in position relative to the magnetic field, and to move the assembly formed of the heating device and quench bath relative to the material and to the magnetic field.

As will be seen below, the materials of the mobile elements are judiciously chosen so as not to generate forces when they are moved. For example, it is possible to use ceramics for the heating elements (silicon carbide, graphite coated with boron nitride) and for the thermally insulating parts such as the walls of the furnace and the quench bath (alumina). Brass, which is not magnetic and is a good electric conductor, can particularly be used for current leads and some fixed parts of the device. Finally 304L stainless steel, which is scarcely magnetic and can withstand high temperatures, may also be used for the mobile parts subjected to high temperatures, the fastenings and some current leads. Evidently, persons skilled in the art may choose other suitable materials in relation to the desired performance levels and costs.

The position of the material in the magnetic field may be chosen in any area of the magnetic field, for example in a homogeneous field (i.e. an area in which the intensity of the magnetic field is substantially equal at every point of the material) or in an area with a field gradient (i.e. an area in which the intensity of the magnetic field varies spatially in the material between a minimum intensity and a maximum intensity). In both cases, the magnetic field is static i.e. the intensity at a given point does not vary cyclically over time and the polarity does not vary. The intensity at a given point of the magnetic field may therefore be constant or it may be modified in stages. For example, the magnetic field may be zero during the thermal treatment and have non-zero intensity during the second step of the treatment.

Depending upon the desired intensity, a certain time lapse may be necessary to change over from zero intensity to the desired intensity; in this case, the increase in the magnetic field is implemented for example at the end of the first step for heat treatment so that the desired intensity is reached at the time of the second treatment. It is also possible to conduct the first heat treatment step by applying temperature holds to the materials, under a static magnetic field having intensity plateaux; the temperature holds and intensity plateaux being substantially simultaneous. It will therefore be understood that a skilled person may define different conditions for applying the thermal treatment and the static magnetic field to obtain the desired microstructures without departing from the scope of the present invention.

In addition, it is possible to conduct the treatment in a controlled atmosphere. For this purpose, the device is positioned in an enclosed chamber provided with valves in which it is possible to control the type of atmosphere and its pressure. This embodiment is particularly advantageous when the treated material cannot withstand an oxidizing atmosphere for example.

The treatment device may also be equipped with a system allowing the in situ measurement of the physical properties of the material. This may concern measurement of resistivity for example. Like the support for the material, the measuring system is then stationary relative to the material and to the magnetic field.

Example of Embodiment in a Laboratory Environment

The detailed example which will be described here concerns the treatment of a sample of material of small size, possibly being in the form of a cylinder for example of the order of 10 mm in height and 5 mm in diameter (first embodiment illustrated in FIGS. 1 and 2) or it may be flat metal sheet no more than 5 mm thick and 50 mm in length, for example a tensile test-piece (second embodiment illustrated in FIG. 3). By way of illustration, the treatment applied to the sample comprises heat treatment followed by quenching in a quench bath but as will be seen below this device can be adapted to allow the application, after the heating step, of any other thermal shock, a thermomechanical treatment and/or chemical treatment. The treatment device is installed in a static magnetic field device whose field hole is vertical and greater than 120 mm in diameter.

In particular, the device described herein was tested in two types of magnets: a superconducting magnet of the CNRS/CRETA laboratory and a resistive magnet of the CNRS/LNCMI laboratory. In the superconducting magnet, the diameter of the field hole at ambient temperature was 120 mm and the magnetic field was 11 T. The homogeneity of the magnetic field on the vertical axis was measured and reached 3% in the particular case of a length of 32 mm corresponding to the effective area of a standard A25 tensile test-piece. The distance between the input of the winding and the homogeneous field area was 935 mm.

In the LNCMI resistive magnet, providing a magnetic field of up to 20 T, the diameter of the field hole at ambient temperature was 160 mm and the distance between the entry into the magnet and the homogeneous field area was 1650 mm. The magnetic field homogeneity was of the order of 0.25% over 32 mm at the position of the maximum field. Evidently, the number values indicated in the present example are given solely by way of indication and are non-limiting.

Sample 1 was held by means of a support 2 in a stationary position relative to the magnetic field. The support 2 is a rigid part which allows the sample 1 to be centred on the axis of revolution of the magnet 3 so as firstly to overcome the strong radial magnetic forces but also to ensure the concentricity of the different mobile parts. The lower part of the support 2, which holds the sample 1 to be treated, is made in alumina. Insofar as this lower part is subjected to strong thermal gradients at the time of quenching, it is preferably replaced at each treatment.

Figure 2:
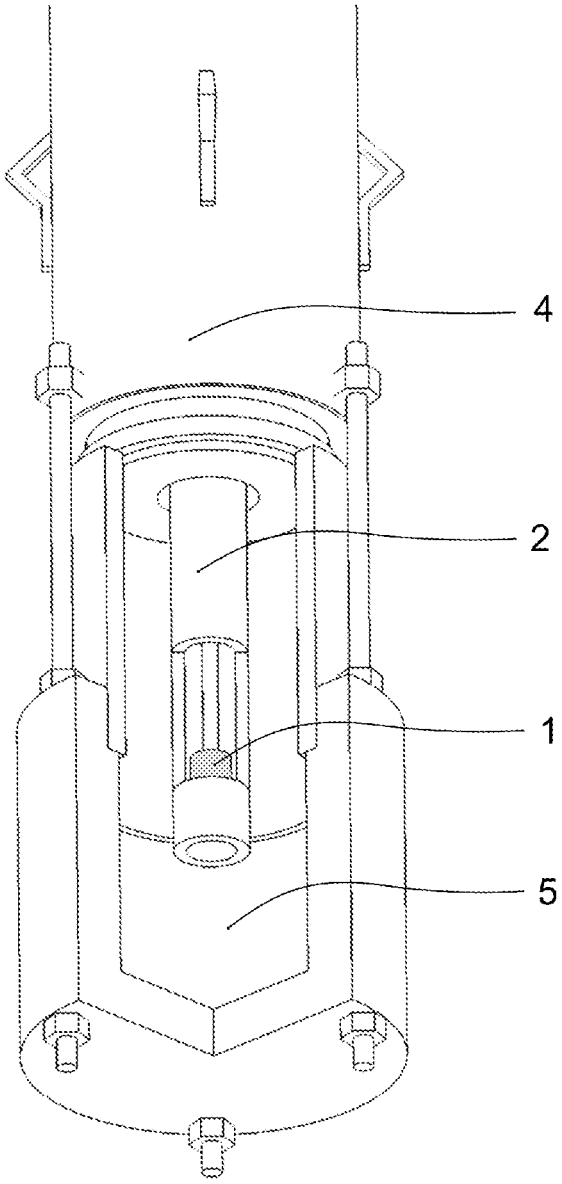
FIG. 2 is a detailed view of the lower part of the device in FIG. 1.

A first configuration of the device illustrated in FIGS. 1 and 2, is adapted for the treatment of samples of cylindrical shape of the order of 10 mm in height and about 5 mm in diameter. The sample 1 is placed inside a heating system 4 formed of a resistive tubular element intended to generate the desired temperature for the heat treatment. The size of the heating area is chosen to ensure good temperature homogeneity over the entire length of the sample. For example, it is 140 mm in length with an inner diameter of 17 mm.

Underneath the heating system 4 there is arranged a quench bath 5. The distance between the temperature homogeneous area of the heating part and the centre of the quench bath is adapted to the stroke of the cylinder, e.g. of the order of 160 mm.

Figure 3:
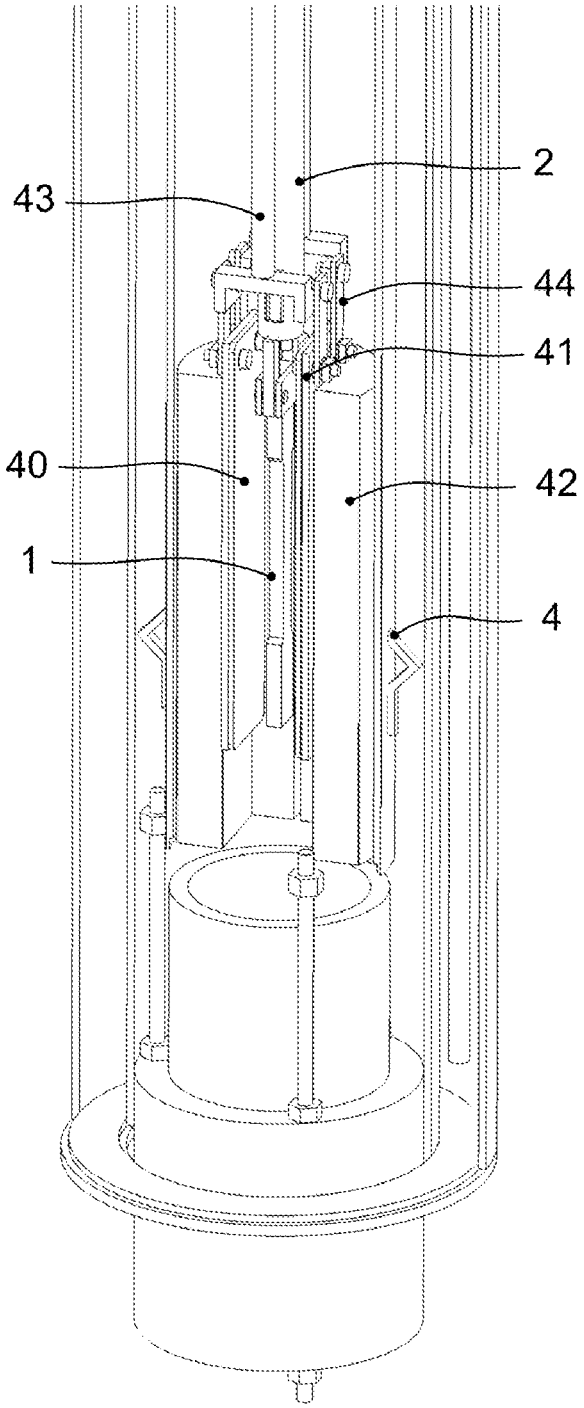
FIG. 3 illustrates a variant of the device of the invention, adapted for the treatment of a flat test-piece such as a tensile test-piece.

A second configuration of the heating system of the device, illustrated in FIG. 3, allows the heat treatment to be performed over a maximum length of 50 mm, of metal sheet with maximum thickness of 5 mm. For this purpose, the heating system 4 is formed of two flat heating elements 40 positioned either side of the test-piece 1 to be treated. These elements in boron nitride have a limit temperature of use of 900° C. in an oxidizing atmosphere and of 1200° C. in a neutral or reducing atmosphere.

On their side opposite the test-piece 1, they are overlaid with an alumina plate 41 and enclosed in an insulating chamber whose wall 42 is also in alumina. The electrical leads 43 to 44 for powering the heating elements 40 are made in 304L stainless steel and molybdenum respectively. The quench bath and the device for generating the magnetic field are not illustrated in FIG. 3.

The elements of the heating device must be made in scarcely magnetic materials to limit the onset of forces when moving in the magnetic field. In practice, a compromise must be found between the magnetic response of a material and its electric conductivity. Preferably, the heating elements and the heat insulating walls are made in ceramic, such as silicon carbide, graphite coated with boron nitride, or alumina.

The quench bath comprises a reservoir in scarcely magnetic material, for example in ceramic which contains a liquid such as water or oil. The transfer of heat during quenching, between the sample previously brought to a high temperature and the fluid in which it is immersed, is a complex process.

However a distinction can be made between three components, namely:

the transfer of heat in the sample, the transfer of heat at the sample/fluid interface, the transmission of heat in the fluid.

Having regard to the strong thermal conductivity of the treated materials and their small size, the heat gradients due to the transfer of heat in the sample are considered to be negligible. The inventors have effectively verified that the microstructures obtained by quenching in a water bath at 20° C. are very homogeneous, from the surface to the core of the sample. With respect to the transfer of heat at the interface and in the fluid, it was verified that the bath temperature remained constant and close to 20° C., and that the volume of evaporated fluid during quenching was negligible.

To ensure that the fluid in the quench bath is at 20° C., the bath is preferably filled just a few seconds before the quench. The bath therefore does not have the time to be heated by the radiation of the furnace.

The use of a propelling device 6 such as a pneumatic cylinder allows the translation of the assembly formed of the heating device and the quench bath at the time of quenching, so that the heating and quenching steps are successively conducted under the influence of the magnetic field, without any movement of the treated material and associated support. This propelling device preferably comprising a cylinder must have good reproducibility regarding its rate of movement.

The shaft of the cylinder being in magnetic stainless steel, it is offset by about one meter from the winding so as not to interact with the field. A shaft extension in non-magnetic stainless steel is used to offset the displacement of the cylinder. It also provides easier access to the device placed underneath the cylinder.

The proposed configuration allows movement of the assembly formed of the heating device and quench bath within the field hole of the device applying the static magnetic field. This is of particular advantage since the device for applying the static magnetic field does not undergo any heat treatment, which would limit the wear thereof, and does not require its replacement between the treatment of two successive samples. According to this configuration, the device for applying the static magnetic field is stationary relative to the support and to the treatment device in general i.e. it is stationary relative to the frame of reference system of the device. Only the first and second systems, for example the heating system and the quench bath, are mobile relative to the support and to the treatment device in general.

Example of Embodiment in an Industrial Treatment Process

The device described below with reference to FIG. 4 forms a complete assembly for treatment at high temperature in a static magnetic field of parts such as metal sheet of industrial size. This large-scale treatment device is designed for the continuous treatment of individual parts by means of the use of three superconducting magnets in circular permutation on a circuit.

Each part 1 to be treated is mounted on a support 2 capable of sliding along a rail 20 or any suitable structure by means of a drive system that is not illustrated. In FIG. 4, the parts 1 circulate horizontally from left to right. The treatment device comprises three identical superconducting magnets 3*a*, 3*b*, 3*c*. As will be seen below, the three magnets are capable of moving horizontally on a rail 30. These superconducting magnets are specially designed to ensure magnetic field homogeneity over the volume of the part to be treated.

The treatment device also comprises an assembly formed of a heating system and a second system for implementing the second step of the method which may be a cooling step in a liquid bath, a surface treatment (salt bath for example) or hot mechanical treatment. The heating system 4 and the second system 5 (e.g. a quench bath) are secured to each other and capable of translating in a vertical direction under the action of a cylinder 6 or any other suitable propelling device.

With the proposed configuration, it is possible to move the assembly formed of the heating system 4 and second system 5 inside the field hole of each superconducting magnet. This is particularly advantageous since the device for applying the static magnetic field does not undergo any heat treatment, which limits wear thereof, and does not require its replacement in between the treatment of two successive samples. According to this configuration, the elements forming the device for applying the static magnetic field are mobile relative to the treatment device in general and to the associated frame of reference, along a first plane of movement e.g. horizontal. The first and second systems, however, are mobile relative to the treatment device in general and to the associated frame of reference, along a second plane of movement perpendicular to the first plane of movement e.g. a vertical plane.

Figure 4:
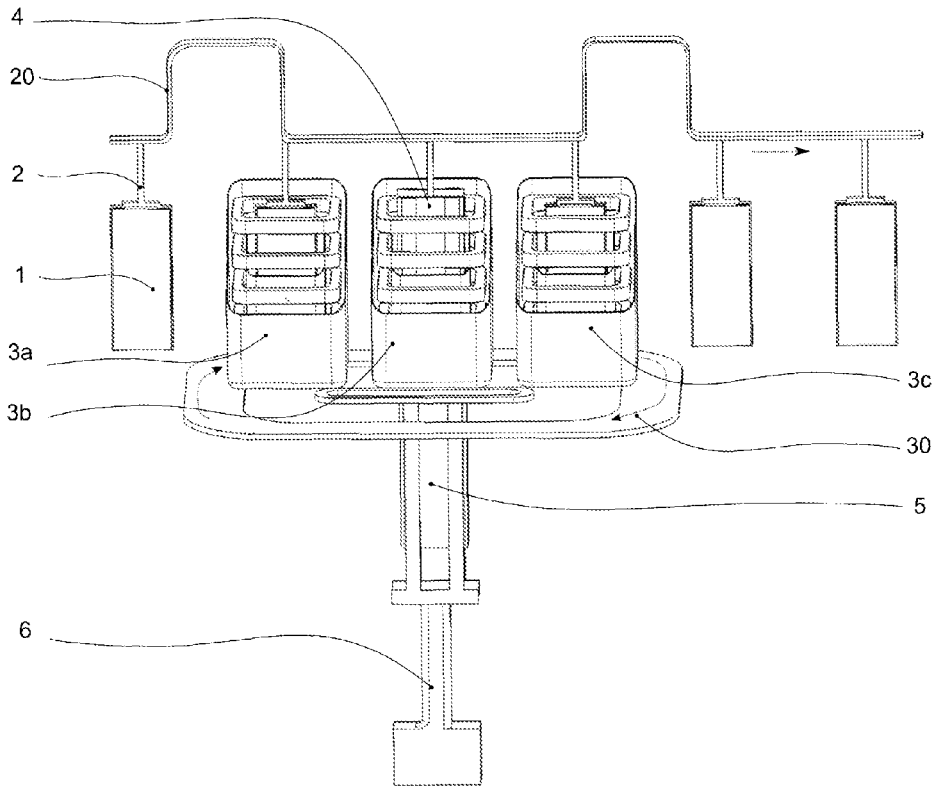
FIG. 4 shows a device for continuous treatment of sheet metal under a magnetic field using the principle of the invention on an industrial scale.

In the example illustrated in FIG. 4, the heating system is arranged above the quench bath. Each of the magnets 3*a*, 3*b*, 3*c* has an upper opening for inserting and removing the part 1 to be treated, and a lower opening for inserting and removing the assembly 4, 5 formed by the heating system and the quench system.

A treatment cycle for a part 1 is conducted as follows.

The part 1 is inserted in the superconducting magnet the furthest to the left in FIG. 4, i.e. magnet 3*a*. At this first step, the magnetic field generated by the magnet 3*a* is zero. Once the part 1 has been inserted in the magnet 3*a*, it remains in position therein and the magnetic field generated by said magnet is increased up to the set point value. When the desired magnetic field is intense, it is not possible to reach the set value instantly. For example, the increase in the magnetic field from zero intensity to an intensity of 10 T requires about 30 minutes.

The assembly formed by the magnet 3*a* and the part 1 subjected to the magnetic field is then moved opposite the heating and quench systems 4, 5. This is made possible by circular permutation of the magnets 3*a*, 3*b* and 3*c* on the rail 30. Said magnet/part assembly then lies at a point occupied by magnet 3*b* in FIG. 4, in order to implement the treatment method on part 1.

During a first phase, the heating system is inserted inside the superconducting magnet and is held therein during the time that is necessary to bring the part 1 to the desired temperature. The system 4, 5 is then again translated upwardly so as to place the quench bath in the magnetic field. Once the quench operation is completed, the system 4, 5 is translated downwardly so that it completely moves outside the magnet. The magnet/part assembly is then moved until it takes up the position occupied by the magnet 3*c* in FIG. 4.

At this third step, the intensity of the magnetic field generated by the magnet is reduced down to a zero value. The part 1 is then extracted from the magnet from above by means of a suitable conformation of the rail 20. The empty magnet is then moved on the rail 30 to re-occupy the position 3*a* in FIG. 4. The duration of the steps implemented simultaneously in the magnets 3*a*, 3*b*, 3*c* is adapted so that it is substantially identical in each thereof.

This treatment is made possible by means of the present invention for the following reasons. Firstly, the relative rate of movement of the part to be treated relative to the magnet is zero at every step of the magnetic treatment, which avoids the inducing of forces through movement of the part inside the field. Secondly, the magnets are the subject of specific engineering so that the magnetic field in the outside vicinity thereof is zero or negligible.

This entails confining the magnetic field inside the outside walls of the magnet through the use of specific materials which allow trapping of the magnetic field lines. This design of the magnets is within the reach of persons skilled in the art. Additionally, the treatment system is specially designed (in particular regarding the choice of materials) so as not to interact with the magnetic field set up by the magnet when it is inserted therein, in the same manner as for the device designed for the samples of smaller size such as described above. Finally, the examples just given are evidently given solely as particular illustrations which are in no way limiting with respect to the fields of application of the invention.

In particular, as specified in the foregoing, the second step of the treatment may comprise thermal shock of rapid cooling type (by quenching for example) or rapid heating, thermomechanical treatment and/or chemical treatment. For example, if the second treatment step entails thermal shock of rapid heating type, the first heating step will entail bringing the sample to a first stabilized temperature e.g. ambient temperature. For this purpose, it is possible for example to place the sample in the quench vessel 5, this vessel being empty or filled with thermalized liquid a given temperature and not undergoing any furnace heating.

During this first step, the furnace 4 remains empty and its temperature is raised. When the desired set temperature is reached in the furnace, the device is translated (reverse movement to the movement for quenching) and the sample is thereby almost instantaneously placed in the furnace for rapid heating, which corresponds to the thermal shock of the second treatment step. The heating is rapid since the heat-up of the sample does not depend on the thermal inertia of the heating device but on the own characteristics of the sample such as geometry, weight, specific heat for example. Therefore, the sample may reach the desired temperature very rapidly, which is not the case with known treatments in which comprise there is the inertia of the furnace temperature rise.

In this manner, heating rates of several tens of degrees per second can be reached, for example heating rates of more than 10° C./s, preferably of more than 20° C./s. Rapid heating can be obtained by means of a furnace regulator thermocouple placed 160 mm above the sample thermocouple, or by means of piloting the furnace power supply. One of the advantages of the proposed treatment device is that it additionally allows the second step in the form of a thermal shock to be followed by an additional treatment step in the form of another thermal shock of opposite type.

If the second treatment step is a thermal shock of rapid heating type as presented above, it is possible to have this step followed by another thermal shock of quench type. To do so, all that is necessary is to translate the assembly formed by the heating system 4 and quench bath so as to remove the sample from the furnace and place it in the quench bath. Similarly, if the second treatment step is a thermal shock of rapid cooling type, this step can be followed by another thermal shock of rapid heating type. In this case, the assembly formed by the heating system and quench bath is translated so as to remove the sample from the quench bath and place it in the furnace (this furnace having been heated up empty during this rapid cooling).

Therefore, according to one aspect of the invention, a method is proposed for treating a material in a static magnetic field having an intensity of more than 1 Tesla, comprising the following steps:

a first step to heat the material, a second step to apply a first thermal shock to the material, a third step to apply a second thermal shock to the material, the second thermal shock being of opposite type to the first thermal shock, the material being subjected to the static magnetic field while being held in position within said magnetic field for at least the second and the third treatment step.

By "second thermal shock of opposite type to the first thermal shock" is meant that the second thermal shock is heating if the first thermal shock is cooling, and respectively the second thermal shock is cooling if the first thermal shock is heating.

The invention claimed is:

1. A device for applying a treatment cycle to a material in a static magnetic field, the treatment cycle comprising heating of the material followed by a subsequent step comprising a thermal shock, a chemical treatment and/or a thermomechanical treatment, the device comprising:

a device operably applying the static magnetic field capable of generating a magnetic field of intensity higher than 1 Tesla, having a shape of revolution with a field hole;

a support arranged to hold the material in a fixed position on the axis of revolution of the device operably applying the static magnetic field during the steps of the cycle;

a first system operably heating of the material; and a second system operably implementing the subsequent step of the cycle;

wherein the first system and second system are secured to each other and are capable of translating along the axis of revolution of the magnet under the action of a propelling device.

2. The device of claim 1, further comprising a device operably translating the first and second systems relative to the material and to the magnetic field.

3. The device of claim 1, wherein the second system comprises a quench bath.

4. The device of claim 1, wherein the second system comprises a bath adapted to perform chemical treatment of the material.

5. The device of claim 1, wherein the second system comprises a system for mechanical deformation of the material.

6. The device of claim 1, further comprising a system measuring physical properties of the material that is fixed relative to the material.

7. The device of claim 1, wherein the device that operably applies the static magnetic field comprises one of: an electromagnet, a superconducting magnet, a resistive magnet, a hybrid magnet or a group of permanent magnets.

8. The device of claim 1, wherein the device that operably applies the static magnetic field comprises at least three superconducting magnets capable of moving along a direction orthogonal to the axis of translation of the first and second systems.

9. A material treatment device comprising:

at least one magnet operably emitting a static magnetic field greater than 1 Tesla within a magnetic field hole;

a heater movable to a position within the magnetic field hole;

a liquid quenching bath movable to a position within the magnetic field hole, the quenching bath creating a temperate decrease of at least 50° C./s; and a material-holding-support remaining stationary while the heater and bath are moved with respect to the magnetic field.

10. The device of claim 9, wherein the at least one magnet includes multiple coaxially aligned and substantially annular superconducting magnets.

11. The device of claim 9, further comprising a workpiece material mechanically moved by the support, the support inserting the workpiece material into and out of the magnetic field hole.

12. The device of claim 9, further comprising a workpiece material being maintained in a constant position within a bore of the at least one magnet when the magnet is magnetically energized, even when the workpiece material is heated and quenched.

13. The device of claim 9, further comprising an actuator operably moving the heater and quenching bath along the same axis into and out of the at least one magnet.

14. The device of claim 9, further comprising:

at least a second magnet operably emitting a static magnetic field greater than 1 Tesla within a second field hole; and centerline axes of the magnets being offset from, substantially parallel to and movable relative to each other.

* * * * *